United States Patent [19]

Yoshida et al.

[11] 4,246,446

[45] Jan. 20, 1981

[54] MOVING COIL PICK-UP WITH COILS PRINTED ON OPPOSITE SIDES OF WAVER

[75] Inventors: Satoshi Yoshida; Masaru Chijiiwa; Shinji Yasuda, all of Tokorozawa, Japan

[73] Assignee: Pioneer Electronic Corporation, Tokyo, Japan

[21] Appl. No.: 971,131

[22] Filed: Dec. 19, 1978

[30] Foreign Application Priority Data

Dec. 23, 1977 [JP] Japan ..... 52-154319

[51] Int. Cl.[3] ..... H04R 9/16; H04R 9/04

[52] U.S. Cl. ..... 369/136; 179/115.5 PV; 336/188; 336/200; 336/228; 369/147

[58] Field of Search ..... 179/100.41 D, 100.41 K, 179/115.5 R, 115.5 PV; 360/123; 336/200, 220, 228, 188

[56] References Cited

U.S. PATENT DOCUMENTS

| | | | |
|---|---|---|---|
| 2,034,872 | 3/1936 | Keller | 179/100.41 D |
| 3,058,078 | 10/1962 | Hott | 336/220 |
| 4,016,519 | 4/1977 | Haas | 336/228 |
| 4,075,591 | 2/1978 | Haas | 336/200 |

FOREIGN PATENT DOCUMENTS

| | | | |
|---|---|---|---|
| 538058 | 7/1941 | United Kingdom | 179/100.41 D |
| 928077 | 6/1963 | United Kingdom | 179/100.41 K |
| 939983 | 10/1963 | United Kingdom | 179/100.41 K |

*Primary Examiner*—Raymond F. Cardillo, Jr.
*Attorney, Agent, or Firm*—Sughrue, Rothwell, Mion, Zinn and Macpeak

[57] ABSTRACT

At least one spiraled semi-circular shaped coil is printed on each surface of a wafer. The coil on a first surface of the wafer is arranged in such a manner that it is rotated 90 degrees with respect to the coil on a second surface thereof. In one embodiment, two such printed coils are symmetrically provided on each surface of the wafer, and the pattern of the printed coils on the first surface is arranged to be rotated 90 degrees with respect to the pattern of the printed coils on the second surface thereof. The spiraling directions of the coils on the same surface are inverse or opposite each other. The inner terminals of the coils on each surface are connected and an output is taken out from the outer terminals thereof, or vice versa. A printed coil is employed, for example, in a moving coil type pick-up cartridge.

8 Claims, 3 Drawing Figures

MOVING COIL PICK-UP WITH COILS PRINTED ON OPPOSITE SIDES OF WAVER

BACKGROUND OF THE INVENTION

This invention relates to a print coil wafer for converting mechanical vibrations into an electrical signal or vice versa.

In a conventional moving coil (MC) type pick-up cartridge, a coil is fixed to one end of a cantilever member and a stylus is secured to the other end thereof. As a result the mechanical vibrations picked up by the stylus are converted into an electrical signal. Generally, since the coils for the MC type cartridges are wound coils, the mass of the coils is relatively large, thereby exerting a bending force on the cantilever member. In addition, the magnetic circuit becomes relatively large. Furthermore, such wound coils are not preferable in terms of mass production, since highly refined techniques are required for accurately winding the coils.

In order to overcome the above drawbacks, a print coil wafer has been proposed, in which a coil, in the form of an electrically conductive coating, is formed or printed on an insulating wafer. However, since the insulating wafer is made of a resin, such as polyamide, in the form of a very thin sheet, the heat-resisting property thereof is poor. As a result, the insulating wafer tends to be creased when the electrically conductive material is coated thereon. Furthermore, since the insulating wafer absorbs ultrasonic vibrations, an ultrasonic bonder cannot be utilized to connect lead lines to the coil on the wafer. Finally, the property of the insulating wafer tends to be deteriorated by its resonance or deformation.

SUMMARY OF THE INVENTION

Accordingly, it is an object of this invention to provide an improved mechanical to electrical, or vice versa, converting element which eliminates the aforementioned disadvantages.

The converting element according to this invention is a print coil wafer having at least one spiraled coil printed on each of its surfaces. The coil printed on the first surface of the wafer is rotated 90 degrees with respect to the coil printed on the second surface thereof. Preferably, two coils are printed on each surface of the wafer, with the spiraling directions of the two coils on the same surface of the wafer being inverse or opposite each other, and with the coils being connected in series. Such a converting element is capable of providing high level output while preventing the production of crosstalk between the coils on the first and second surfaces.

This invention will be described with respect to the accompanying drawings and the description of the preferred embodiment that follows.

DETAILED DESCRIPTION OF THE PREFERRED EMBODIMENT

One embodiment according to the present invention will now be described with reference to the accompanying drawings.

Figure 1:
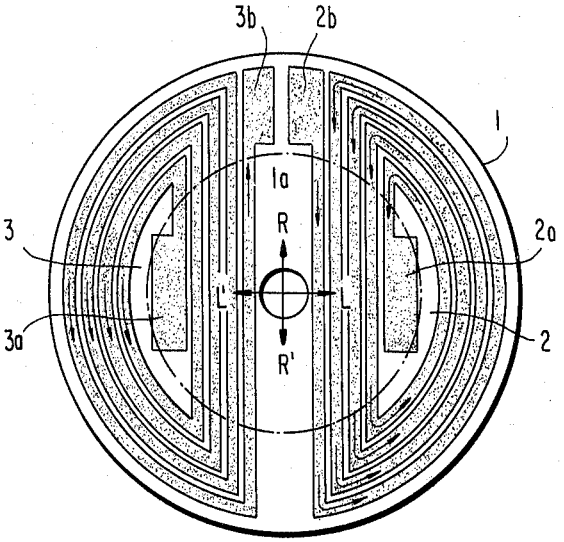
FIG. 1 is a plan view of the print coil wafer showing the front surface.

Referring to FIG. 1, there is illustrated a front surface of a print coil wafer adapted to be employed in a MC type pick-up cargridge. An aperture 1*a* is formed at the center of a wafer 1 for receiving a cantilever member. Spiral coils 2 and 3 of a semi-circular or D shape are symmetrically printed on the right-hand and left-hand of the wafer 1, respectively. As shown, the spiraling direction of the coil 3 is inverse or opposite that of the coil 2. The inner terminals 2*a* and 3*a* of the coils 2 and 3 are connected to each other, and an output is taken out from the outer terminals 2*b* and 3*b* thereof.

Figure 2:
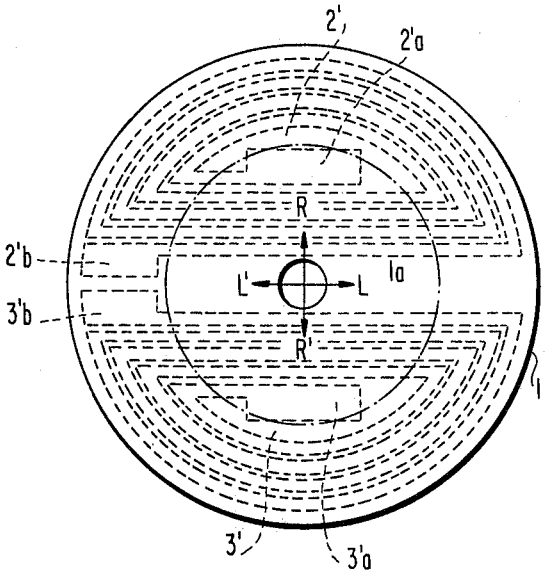
FIG. 2 is a plan view of the print coil wafer viewed from the front surface showing the rear surface.

FIG. 2 shows a condition where the coils 2 and 3 are removed from the front surface of the wafer 1 to illustrate the rear surface thereof as viewed from the front side. Coils 2' and 3' corresponding to the coils 2 and 3, respectively, are printed on the rear surface thereof in such a manner that the latter is rotated 90 degrees about the aperture 1*a* with respect to coils 2 and 3.

The annular portion of the print coil wafer outside the encircled portion defined by a two-dotted chain line is located in a magnetic gap in which a magnetic field is perpendicular to the surface of the wafer from the front to the rear direction. If the wafer is moved in the L-direction, electromotive forces are generated in the coils 2 and 3 in the counter-clockwise direction designated by arrows in FIG. 1. These electromotive forces appear on the outer terminals 2*b* and 3*b* in an added mode provided that the inner terminals 2*a* and 3*a* are connected.

If, on the other hand, the coils 2 and 3 are moved to L'-direction, the electromotive forces are generated in the direction opposite to the arrows. That is, if the coils vibrate in L-L' direction, the corresponding electromotive force is obtained from the output terminals 2*b* and 3*b*. In the case where the coils 2 and 3 vibrate in R-R' direction, the upper and lower parts of the coils 2 and 3 cut the magnetic flux. This results in the generation of electromotive forces; however, these electromagnetic forces cancel each other. As a result, no output is obtained from the outer terminals 2*b* and 3*b*.

The coils on the rear surface of the wafer 1 are arranged with reference to the coils on the front surface thereof so that the electromotive forces generated in the coils 2' and 3' are added when the coils 2' and 3' vibrate in R-R' direction. Accordingly, an output appears on the outer terminals 2'*b* and 3'*b*. Electromotive forces generated when the coils 2' and 3' vibrate in L-L' direction are cancelled for the same reason as above.

Accordingly, the output signal in accordance with L-L' directional vibtation appears only on the outer terminals 2*b* and 3*b* of the coils 2 and 3 on the front surface, while the output signal in accordance with the R-R' directional vibration appears only on the outer terminals 2'*b* and 3'*b* of the coils 2' and 3' on the rear surface. Crosstalk between the coils on the front and the rear surfaces is not produced according to the print coils wafer arranged in this manner.

The case has been described where the magnetic field is applied to the annular portion of the wafer; however, the same operational effect is obtainable by the application of magnetic field to the inner portion encircled by the two dotted chain line of the wafer. Furthermore, since the connection of the coils is on each surface, it is possible to connect the outer terminals of the coils and to take out the output from the inner terminals thereof.

The wafer according to the present invention comprises a non-magnetic metal in the form of a thin sheet and an insulating layer formed on the surfaces of the non-magnetic metal. The non-magnetic metals are typically aluminium, beryllium or the like. In the case where the non-magnetic metal is beryllium the insulating layer is typically silicon evaporated thereon, while in the case where the non-magnetic metal is aluminium, the insulating layer is silicon evaporated thereon or an alumite which is formed by anodizing the aluminium wafer itself.

Figure 3:
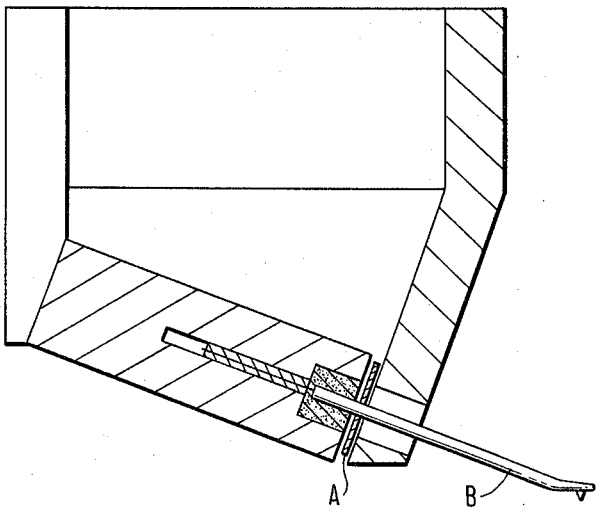
FIG. 3 is a sectional view showing the case where the print coil wafer is utilized in an MC type cartridge.

FIG. 3 is a sectional view showing the pick-up cartridge where the print coil wafer A is fixed to the cantilever member and magnetic field is applied to the outer portion of the wafer A.

As described, according to the present invention, the mechanical vibration can be electrically converted, and the electrical signal corresponding to the mechanical vibration can be obtained from the both surfaces of the wafer without any mutual interference. It is, of course, possible to convert the electrical signal into the mechanical vibration according to the principle of the invention.

Further, according to the invention, the effective length of the coils can be lengthened by connecting the two coils on each surface of the wafer, and thus high level outputs can be obtained. Furthermore, since the wafer is, as the term implies, a thin plate, the converting efficiency and the sensitivity is enhanced. In addition, the deformation of the wafer caused by temperature variation is prevented, since the wafer is made of a non-magnetic metal sheet. Therefore, an ultrasonic bonder, for example, can be utilized to connect the lead lines to the wafer without causing any deformation. Accordingly, by utilizing the above-described coil as a coil for the MC type pick-up cartridge, the various characteristics of the cartridge are excellent in comparison with that of the conventional MC type pick-up cartridge employing a winding coil.

It should be noted that the application of printed coils thus arranged is not limited to only a pick-up cartridge, but it is applicable extensively such as to coils in the cutter portion of a record disc cutting machine, coils for electromagnetic braking, or the like.

While the invention has been explained herein with respect to this preferred embodiment it is obvious that it can be applied with other modifications still within the purview of this invention.

We claim:

1. A moving coil pick-up for converting a first signal into a second signal and having spiral coils printed on an insulating wafer, each coil having respective inner and outer terminals, wherein the improvement comprises:

first and second semi-circular D-shaped coils printed on one surface of the wafer, said coils being oriented such that their respective straight lines of the D-shape are spaced apart and parallel to each other, said coils being spiraled in opposite directions;

third and fourth semi-circular D-shaped coils printed on the other surface of the wafer, said coils being oriented such that their respective straight lines of the D-shape are spaced apart and parallel to each other, said coils being spiraled in opposite directions; and the pair of first and second coils being angularly displaced by 90° with respect to the third and fourth coils such that the straight lines of said first and second coils are at an angle of 90° relative to the straight lines of said third and fourth coils.

2. The transducer as recited in claim 1, wherein the inner terminals of the two coils on each surface of the wafer are connected to each other.

3. The transducer as recited in claim 1, wherein the outer terminals of the two coils on each surface of the wafer are connected to each other.

4. The transducer as recited in claims 1, 2 or 3, wherein said first signal is a mechanical signal, and said second signal is an electrical output signal.

5. The transducer as recited in claims 1, 2 or 3, wherein said first signal is an electrical signal, and said second signal is a mechanical output signal.

6. The transducer as recited in claims 1, 2 or 3, wherein the wafer comprises a non-magnetic metal in the form of a thin sheet and an insulating layer formed on said metal sheet.

7. The transducer as recited in claim 6, wherein said non-magnetic metal is aluminum.

8. The transducer as recited in claim 6, wherein said non-magnetic metal is beryllium.

* * * * *